US005436122A

United States Patent [19]

Shigetomi

[11] Patent Number: 5,436,122

[45] Date of Patent: Jul. 25, 1995

[54] SILVER HALIDE COLOR PHOTOGRAPHIC LIGHT-SENSITIVE MATERIAL COMPRISING A SOLID PARTICLE DISPERSION OF A SPECTRAL SENSITIZING DYE, AND HAVING A TOTAL COATING WT OF AG LESS THAN 4 G/M$^2$

[75] Inventor: Yoshiro Shigetomi, Tokyo, Japan

[73] Assignee: Konica Corporation, Japan

[21] Appl. No.: 248,259

[22] Filed: May 24, 1994

[30] Foreign Application Priority Data

May 31, 1993 [JP] Japan ..... 5-149756

[51] Int. Cl.$^6$ ..... G03C 1/08

[52] U.S. Cl. ..... 430/508; 430/567; 430/570; 430/502; 430/503

[58] Field of Search ..... 430/503, 502, 508, 570, 430/567

[56] References Cited

U.S. PATENT DOCUMENTS

| | | | |
|---|---|---|---|
| 4,474,872 | 10/1984 | Onishi et al. | 430/570 |
| 4,683,193 | 7/1987 | Ihama et al. | 430/570 |
| 4,837,140 | 6/1989 | Ikeda et al. | 430/550 |
| 4,952,485 | 8/1990 | Shibahara et al. | 430/502 |
| 5,057,405 | 10/1991 | Shiba et al. | 430/508 |

FOREIGN PATENT DOCUMENTS

| | | |
|---|---|---|
| 423693 | 4/1991 | European Pat. Off. . |
| 3246826 | 6/1983 | Germany . |

*Primary Examiner*—Charles L. Bowers, Jr.
*Assistant Examiner*—Geraldine Letscher
*Attorney, Agent, or Firm*—Jordan B. Bierman; Bierman and Muserlian

[57] ABSTRACT

A silver halide color photographic light sensitive material comprising a support having thereon light-sensitive silver halide emulsion layers, and a nonlight-sensitive hydrophilic colloidal layer, wherein the color photographic material has a coating weight of silver of not more than 4.0 g per m$^2$ of a photographic material and an ISO speed of 25 or more, and wherein a silver halide emulsion contained in at least one of the light-sensitive emulsion layers is spectrally sensitized by a process comprising (i) forming a dispersion of a substantially water-insoluble spectral sensitizing dye in the form of solid particles dispersed in an aqueous medium which is free from an organic solvent or a surfactant and (ii) incorporating the dispersion in the silver halide emulsion.

8 Claims, No Drawings

SILVER HALIDE COLOR PHOTOGRAPHIC LIGHT-SENSITIVE MATERIAL COMPRISING A SOLID PARTICLE DISPERSION OF A SPECTRAL SENSITIZING DYE, AND HAVING A TOTAL COATING WT OF AG LESS THAN 4 G/M$^2$

FIELD OF THE INVENTION

This invention relates to a silver halide color photographic light-sensitive material and, particularly, to a silver halide color photographic light-sensitive material excellent in preservability and processability, that is a satisfactorily silver-saving color photographic light-sensitive material.

BACKGROUND OF THE INVENTION

The recent technical progress of a silver halide color photographic light-sensitive materials (hereinafter sometimes referred to as a 'color light-sensitive material' or simply a 'light-sensitive material') has been remarkable. It is the matter of course on the one hand that the improvements of photographic characteristics such as sensitivity and image-quality have been required as heretofore, and on the other hand that every product has recently been required further to have a global environmental aptitude from the viewpoints of a resource-saving, an energy-saving and environmental issues.

For the saving of resources, a light-sensitive material has been demanded to save a coating weight of silver as much as possible, from the viewpoint for making effective use of a valuable silver resource as a raw material of silver halide grains applicable to a light-sensitive material. However, in a low silver-containing light-sensitive material, it has been difficult to save a silver content drastically, because the drastic saving thereof results in deterioration in image-qualities, particularly a graininess, and it also induces lowering of a contrast gradation and a color density, which are necessary for photographic characteristics.

Generally, when reducing an silver coating weight from a color light-sensitive material, there have been some instances where a coupler amount is increased in or a highly developable silver halide is introduced into a light-sensitive material so as to enhance a color density. Each of these measures is rather unfavorable for a processing stability of a light-sensitive material. Particularly, in such a processing system as a mini-lab that has recently been on the rise, the demands from a mini-lab for the processing stability of a light-sensitive material have been particularly getting increased more than ever, because a rapid and low-replenishing process has been the main process.

From the viewpoint of a quality control, the essential factors include not only variations in sensitivity, and image-quality produced by a processing fluctuations, but also a characteristic change produced during a period from the delivery of the light-sensitive material to the development process (so-called shelf-life). According to the studies performed by the present inventors, it has become clear that an ordinary negative type light-sensitive material for picture-taking use is hardly affected by the environmental conditions when the silver coating weight of the light-sensitive material is not less than 4.5 g/m$^2$, but some kind of storage stabilities are seriously affected by the environmental conditions when the silver coating weight thereof is not more than 4.5 g/m$^2$ so as to deteriorate the photographic characteristics thereof.

On the other hand, it has been well-known to spectrally sensitize a silver halide emulsion applicable to a color light-sensitive material. Most of the spectral sensitizing dyes used for the spectral sensitization are insoluble in water. It is generally known in the art to dissolve a sensitizing dye in a solvent and then to add the solution to a silver halide emulsion.

As for the solvents for a sensitizing dye, particularly, a water-miscible organic solvent has so far been used. For example, alcohol, ketone, nitrile and alkoxy alcohol have been used for. The typical examples thereof include methanol, ethanol, n-propyl alcohol, isopropyl alcohol, ethylene glycol, propylene glycol, 1,3-propane-diol, acetone, acetonitrile, 2-methoxy-ethanol and 2-ethoxy-ethanol.

There is a widely known technique in which a surfactant is used for dissolving a sensitizing dye. Such a surfactant as mentioned above include, for example, an anionic type surfactant, a cationic type surfactant, a nonionic type surfactant and an amphoteric type surfactant.

However, when making use of a conventionally ordinary sensitizing technique is applied to a silver halide emulsion having a relatively small silver content, it is not satisfactorily cope with a shelf-life, a processing stability and so forth. Therefore, an improvement thereof has been demanded so far.

A technique for mechanically dispersing an organic dye in an aqueous medium is known in Japanese Patent Publication Open to Public Inspection (hereinafter referred to as JP OPI Publication) No. 3-288842/1991. However, this technique is to prevent an organic dye from diffusing in a photographic light-sensitive material. It is only a dispersion-addition technique and the purpose of making use of this technique is quite different from the purpose of making a spectrally sensitizing dye adsorbed uniformly and effectively to the surfaces of silver halide grains.

Accordingly, the present inventors have variously studied on low silver coverage light-sensitive materials capable of contributing the saving of resources so as to provide a light-sensitive material excellent in shelf-life and processing stability. As the results, they have discovered that such a light-sensitive material as mentioned above can be provided by mechanically dispersing a sensitizing dye in a system having no organic solvent nor surfactant and then by adding the resulting dispersion to the light-sensitive material.

SUMMARY OF THE INVENTION

It is an object of the invention to provide a color light-sensitive material excellent in processing stability and storage stability without any deterioration of graininess, and, at the same time, the light-sensitive material has a relatively low coating weight of silver and capable of contributing to the saving of resources.

The above-mentioned object of the invention can be achieved with the following silver halide color photographic light-sensitive material.

A silver halide color photographic light-sensitive material comprising a support bearing a blue-sensitive silver halide emulsion layer, a green-sensitive silver halide emulsion layer and a red-sensitive silver halide emulsion layer and at least one hydrophilic colloidal layers substantially having no light-sensitivity; wherein the total coating amount of silver of the silver halide color photographic light-sensitive material is not more than 4.0 g/m$^2$ and the photographic sensitivity thereof is not lower than 25 in terms of ISO speed, and a silver halide emulsion contained in at least one of the color-sensitive layers is spectrally sensitized by adding a substantially water-insoluble spectrally sensitizing dye in the form of solid particle dispersion without making use of any organic solvent.

DETAILED DESCRIPTION OF THE INVENTION

A total amount of silver coated on a support is essential for the invention. An amount of silver can be measured in a fluorescent X-ray method. A total coating amount of silver include silver halide and colloidal silver each having substantially no light-sensitivity. In the present invention, a total coating amount of silver coated on a silver halide color photographic light-sensitive material is characteristically not more than 4.0 g/m$^2$.

Concerning a silver halide color photographic light-sensitive material, such a study as those on how to save a silver coating amount as much as possible has also been progressed by making effective utilization of valuable silver resources.

However, when a silver amount is drastically decreased in a light-sensitive material, there raises such a problem that a color density is lowered, and particularly that a contrast gradation necessary for a picture-taking light-sensitive material is lost, so that the light-sensitive material can hardly be constituted. In a light-sensitive material of the invention, a total amount of silver coated thereon is to be within the range of, preferably, 1.5 to 4.0 g/m$^2$ and, more preferably, 2.5 to 4.0 g/m$^2$.

As for a halide composition of silver halide grains useful to be applied to the invention, they have preferably not less than 3 mol % of the silver iodide content of the whole silver halide emulsion layer constituting a light-sensitive material. Therefore, they may have the above-mentioned specific silver iodide content as a light-sensitive material as a whole, provided that silver halide grains contained in some layer may be out of the above-mentioned specific range of the silver iodide content.

In the invention, it is characterized in that a support is provided thereon with at least one each of red-sensitive, green-sensitive and blue-sensitive layers, respectively. Each of the light-sensitive layers may comprise plural layers. Each of the light-sensitive layers may comprise, preferably, one to five layers and, particularly, two or three layers. When the color-sensitive layer comprises plural layers, it is preferred to be comprised of plural layers such as those having substantially the same color-sensitivity, but having the different photographic speeds; e.g., a high-speed layer, a medium-speed layer and a low-speed layer. The expression, 'substantially the same color-sensitivity', herein means that the blue-sensitivity, green-sensitivity or red-sensitivity of the plural layers is the same with each other, provided that the spectral sensitivity shall not be required to be completely the same with each other. The layers are also allowed to have either one of the so-called normal-layer arrangement and a inverted layer arrangement.

It is also allowed to coat a layer substantially having no light-sensitivity between the respective light-sensitive layers.

There is no special limitation to the grain sizes of silver halide applicable to the invention. However, the grain-sizes thereof are to be within the range of, preferably, 0.1 to 3 μm and, particularly, 0.2 to 2 μm, from the viewpoints of an image property and a processability varied by the developability differences produced by grain-sizes, as well as the viewpoint of a graininess. As for the structure of silver halide grains, core/shell type silver halide grains are preferred. The term, a 'core/-shell type', herein means that the silver halide composition of a silver halide grain is different between the inside of a grain and the surface thereof.

Furthers, monodisperse grains are preferred. As a whole of silver halide grains contained in each of silver halide emulsion layers, a variation coefficient defined by a ratio S/r of a standard grain-size deviation (S) to an average grain-size (r) is to be, preferably, not higher than 0.4, more preferably, :not higher than 0.33, further, not higher than 0.25 and, particularly, not higher than 0.20.

The term, 'an average grain-size (r)', is herein defined by the following formula 1, provided that the number of grains having a grain-size ri is ni (in the case of cubic silver halide grains, ri is the length of a side and, in the cases of grains having other configurations than a cube, ri is the length of a side converted into a cube having the same volume as that of each grain.). A standard deviation (S) of a grain-size is represented by the following formula 2.

$$S = \frac{\sqrt{\Sigma(r - ri)^2 ni}}{\Sigma ni} \qquad \text{Formula 1}$$

$$r = \frac{\Sigma ni \cdot ri}{\Sigma ni} \qquad \text{Formula 2}$$

A monodisperse core/shell type silver halide emulsion applicable to the invention such as those mentioned above can be prepared in the known processes disclosed in JP OPI Publication Nos. 59-177353/1984, 60-138538/1985, 59-52238/1984, 60-143331/1985, 60-35726/1985 and 60-25853/1985.

In the invention, tabular-shaped grains may also be used.

A silver halide emulsion of the invention can be prepared in the manner that the pAg and pH of a liquid phase in which silver halide grains are nucleated and grown up, and the temperature and stirring of the liquid phase are each so controlled as to get into the respective specific patterns; that an addition of a halide such as sodium chloride, potassium bromide and potassium iodide, and an addition of silver nitrate are controlled; and that an emulsion preparation apparatus is used in a double-jet method. Besides, a finely grained emulsion comprising silver halide fine grains having substantially no light-sensitivity and having a grain-size of 0.01 to 0.2 μm may be prepared in the same manner as mentioned above so as to be used in a protective layer and an interlayer.

The expression, 'substantially no light-sensitivity', herein means a sensitivity of not higher than 1/50 of the sensitivity of the lowest sensitive grains contained in a light-sensitive emulsion layer.

For obtaining a wide exposure-latitude in the invention, a plurality of silver halide emulsions each having the different grain-sizes or the different halide compositions may be mixed in the same component layer in any proportions.

As for the blended silver halide grains each having the different grain-sizes, it is preferable to make combination use of silver halide grains having larger grain-size, which have an average grain-size within the range of 0.2 to 2.0 μm, and silver halide grains having smaller average grain-size, which have an average grain-size within the range of 0.05 to 1.0 μm. It is also allowed to make combination use of not less than one kind of silver halide grains having an intermediate average grain-size. It is further preferable that the average grain-size of silver halide grains having larger average grain-size is to be within the range of 1.5 to 40 times as large as the average grain-size of silver halide grains having smaller average grain-size.

In the embodiment of the invention, the photographic sensitivity is not lower than 25 in terms of ISO speed.

The photographic sensitivity of a light-sensitive material used in the invention is determined by the following test method which corresponds to,the test method of ISO speed. (corresponding to JIS K 7614–1981)

(1) Testing Conditions

Tests are carried out in a room conditioned at 20°±5° C. and 60±10% relative humidity. Prior to testing, a test sample of a light-sensitive material is allowed to stand for at least 1 hour.

(2) Exposing

1) The relative spectral energy distribution of the standard light at the exposed surface is as follows:

TABLE 1

| Wavelength (nm) | Relative Spectral Energy (1) |
|---|---|
| 360 | 2 |
| 370 | 8 |
| 380 | 14 |
| 390 | 23 |
| 400 | 45 |
| 410 | 57 |
| 420 | 63 |
| 430 | 62 |
| 440 | 81 |
| 450 | 93 |
| 460 | 97 |
| 470 | 98 |
| 480 | 101 |
| 490 | 97 |
| 500 | 100 |
| 540 | 102 |
| 550 | 103 |
| 560 | 100 |
| 570 | 97 |
| 580 | 98 |
| 590 | 90 |
| 600 | 93 |
| 610 | 94 |
| 620 | 92 |
| 630 | 88 |
| 640 | 89 |
| 650 | 86 |
| 660 | 86 |
| 670 | 89 |
| 680 | 85 |
| 690 | 75 |
| 700 | 77 |

Notes
(1): shown in values relative to the value at 560 nm which is set at 100.

2) The illumination intensity at the exposed surface is varied using an optical wedge, whose fluctuation in spectral transmission density in the wavelength range of 360 to 700 nm should be, at its every portion, less than 10% for the light below 400 nm and less than 5% for the light above 400 nm.

3) The exposing time is 1/100 second.

(3) Processing

1) Exposed light-sensitive material samples are kept at 20°±5° C. and 60±10% relative humidity till these are subjected to processing.

2) Processing is completed within the period ranging from 30 minutes to 6 hours after exposing.

3) Processing is carried out in accordance with Eastman Kodak Company's Processing C-41 described in British Journal of Photography Annual 1988, pp. 196–198.

(4) Densitometry

Densities are expressed in $\log_{10}(\Phi_0/\Phi)$, where $\Phi_0$ is an illuminating light flux for densitometry and $\Phi$ is a transmitted light flux at a measured portion. The geometrical requirement in densitometry is that the illuminating light flux is a parallel light flux in normal direction, and the whole light flux transmitted and diffused to a semi-sphere is taken as the transmitted light flux. When measurements are made otherwise, correction must be made by use of a standard density specimen. At a measurement, the emulsion layer side is faced with the light-receiving apparatus side. In carrying out the densitometry, status M densities of blue, green and red are used,, and their spectral characteristics are controlled so as to give the values shown in Tables 1 and 2 as the overall characteristics of a light source used for thermometer, an optical system, an optical filter and a light-receiving apparatus.

TABLE 2

| Status M Density Spectral Characteristics (in logarithms, the peak value is standardized to 5.00) | | | |
|---|---|---|---|
| Wavelength nm | Blue | Green | Red |
| 400 | −0.40 | −6.29 | −55.1 |
| 410 | 2.10 | −5.23 | −52.5 |
| 420 | 4.11 | −4.17 | −49.9 |
| 430 | 4.63 | −3.11 | −47.3 |
| 440 | 4.37 | −2.05 | −44.7 |
| 450 | 5.00 | −0.99 | −42.1 |
| 460 | 4.95 | 0.07 | −39.5 |
| 470 | 4.74 | 1.13 | −36.9 |
| 480 | 4.34 | 2.19 | −34.3 |
| 490 | 3.74 | 3.14 | −31.7 |
| 500 | 2.99 | 3.79 | −29.1 |
| 510 | 1.35 | 4.25 | −26.5 |
| 520 | −0.85 | 4.61 | −23.9 |
| 530 | −3.05 | 4.85 | −21.3 |
| 540 | −5.25 | 4.98 | −18.7 |
| 550 | −7.45 | 4.98 | −16.1 |
| 560 | −9.65 | 4.80 | −13.5 |
| 570 | −11.9 | 4.44 | −10.9 |
| 580 | −14.1 | 3.90 | −8.29 |
| 590 | −16.3 | 3.15 | −5.69 |
| 600 | −18.5 | 2.22 | −3.09 |
| 610 | −20.7 | 1.05 | −0.49 |
| 620 | −22.9 | −0.15 | 2.11 |
| 630 | −25.1 | −1.35 | 4.48 |
| 640 | −27.3 | −2.55 | 5.00 |
| 650 | −2.95 | −3.75 | 4.90 |
| 660 | −31.7 | −4.95 | 4.58 |
| 670 | −33.9 | −6.15 | 4.25 |
| 680 | −36.1 | −7.35 | 3.88 |
| 690 | −38.3 | −8.55 | 3.49 |
| 700 | −4.05 | −9.75 | 3.10 |
| 710 | −42.7 | −10.9 | 2.69 |
| 720 | −44.9 | −12.2 | 2.27 |
| 730 | −47.1 | −13.4 | 1.86 |
| 740 | −49.3 | −14.6 | 1.45 |

TABLE 2-continued

| Status M Density Spectral Characteristics (in logarithms, the peak value is standardized to 5.00) | | | |
|---|---|---|---|
| Wavelength nm | Blue | Green | Red |
| 750 | −51.5 | −15.8 | 1.05 |

(5) Determination of Specific Photographic Sensitivity

Using values measured under the conditions shown in paragraphs (1) to (4), the specific photographic sensitivity is determined by the following procedure:

1) Exposures corresponding to the densities higher than respective minimum densities of blue, green and red by 0.15, which are expressed in lux-sec, are referred to as $H_B$, $H_G$ and $H_R$, respectively.
2) Of $H_B$ and $H_R$, the larger one (one lower in sensitivity) is referred to as $H_s$.
3) The photographic sensitivity S is calculated using the following equation:

$$S = \sqrt{\frac{2}{H_G \times H_S}}$$

The invention can be applied to a variety of color photographic light-sensitive materials represented by a color negative film and color positive film each for general use.

In a color photographic light-sensitive material of the invention, total thickness of the whole hydrophilic colloidal layers on the emulsion layer side of the light-sensitive material is, preferably not thicker than 24 μm, more preferably not thicker than 20 μm and, particularly not thicker than 18 μm. The layer swelling speed $T_{\frac{1}{2}}$ is preferably not longer than 30 seconds and, more preferably not longer than 20 seconds. A layer thickness means that measured under the conditions at 25° C. and 55%RH (for 2 hours). The swelling speed $T_{\frac{1}{2}}$ can be measured in a manner as well-known in the art.

The swelling speed $T_{\frac{1}{2}}$ can be controlled by adding a hardener to gelatin as a binder, or by changing an aging condition after coating. A degree of swell is preferable to be within the range of 150 to 400%, and it can be calculated from the maximum swelled layer thickness obtained under the above-mentioned conditions in accordance with a formula: (The maximum swelled layer thickness−Layer thickness) /Layer thickness.

A substantially water-insoluble spectrally sensitizing dye for photographic use, which are applicable to the invention, is added in an aqueous system without making present any organic solvent and/or any surfactant therein in an amount exceeding the solubility thereof and mechanically dispersed in the form of fine solid particles having sizes of not larger than 1 μm.

In contrast to the technique disclosed in the foregoing JP OPI Publication No. 3-288842/1991, the invention is to make a spectrally sensitizing dye for photographic use adsorbed uniformly and effectively. Therefore, the objects and effects of the invention are different from the above-given technique only for dispersing and adding a spectrally sensitizing dye for photographic use.

In the invention, any one of such an organic solvent as the above-mentioned solvents which have conventionally been used so far is not contained substantially. As aforementioned, any surfactant which has so far been used as a dispersing agent is not substantially contained.

In the invention, the expression, 'an aqueous system in which any organic solvent and/or surfactant are not present substantially', herein means water, and means preferably ion-exchange water.

In the invention, a solubility of a spectrally sensitizing dye in water is to be within the range of $2\times10^{-4}$ to $4\times10^{-2}$ mols/liter and, preferably, $1\times10^{-3}$ to $4\times10^{-2}$ mols/liter.

To be more concrete, when a solubility is lower than the above-mentioned range, a dispersed particle size becomes remarkably larger and ununiform. It was, therefore, found out that a dispersion was precipitated after completing a dispersion, and that a dye adsorption to silver halide was hindered when a dispersion was added to a silver halide emulsion.

When a solubility is higher than the foregoing range, it was found out in the studies made by the present inventors that a dispersion was deteriorated by unnecessarily increasing the viscosity of a dispersion and then by taking babbles in, so that the dispersion could not be performed with a further higher solubility.

In the invention, the term, 'a spectral sensitizing dye', herein means that, when it is adsorbed to silver halide, an electron transfer to the silver halide is performed by a photoexcitation, provided that no organic dye shall not be included.

Any spectral sensitizing dyes may be used in the invention, provided that they have a solubility to water within the range of $2\times10^{-4}$ to $4\times10^{-2}$ mols/liter. They include, preferably, a cyanine dye and, more preferably, a cyanine dye having a hydrophilic group such as —$SO_3H$ and —COOH.

Now, the typical examples thereof and the solubilities thereof in water will be given below; provided, however, that the invention shall not be limited thereto.

| | | Solubility in water in terms of mol/liter |
|---|---|---|
| S-1 | 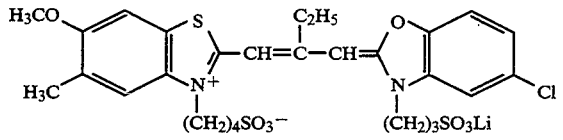 | $13.1 \times 10^{-3}$ |
| S-2 | 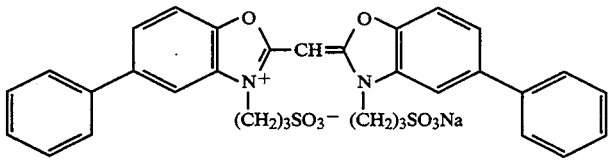 | $11.0 \times 10^{-3}$ |

-continued
| | | Solubility in water in terms of mol/liter |
|---|---|---|
| S-3 | 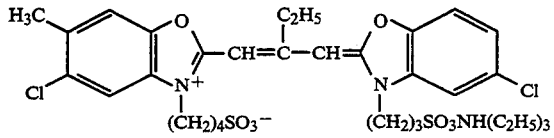 | $8.21 \times 10^{-3}$ |
| S-4 | 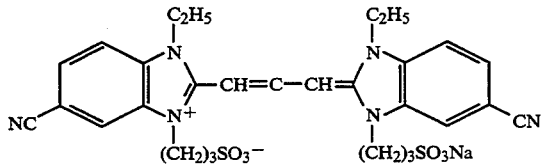 | $5.75 \times 10^{-3}$ |
| S-5 | 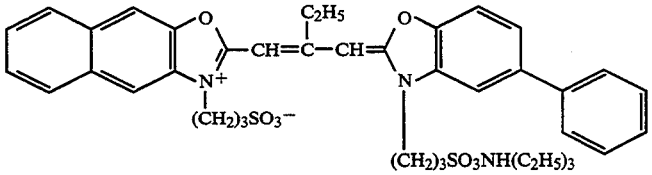 | $3.69 \times 10^{-3}$ |
| S-6 | 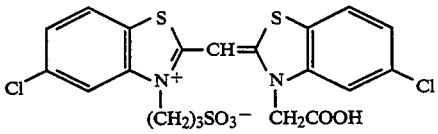 | $1.6 \times 10^{-3}$ |
| S-7 | 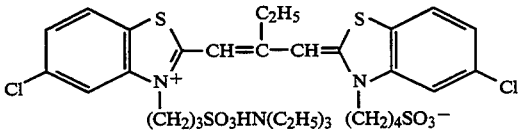 | $1.42 \times 10^{-3}$ |
| S-8 | 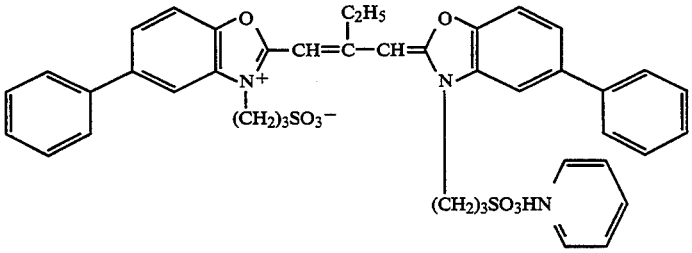 | $0.89 \times 10^{-3}$ |
| S-9 | 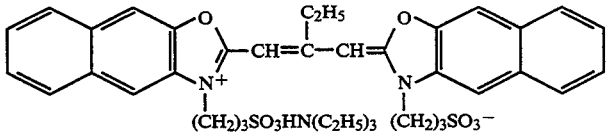 | $0.37 \times 10^{-3}$ |
| S-10 | 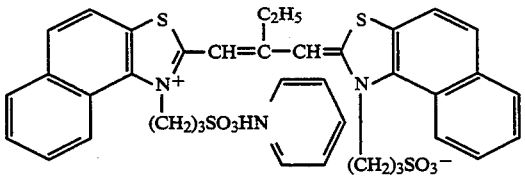 | $0.30 \times 10^{-3}$ |

-continued

| | | Solubility in water in terms of mol/liter |
|---|---|---|
| S-11 | 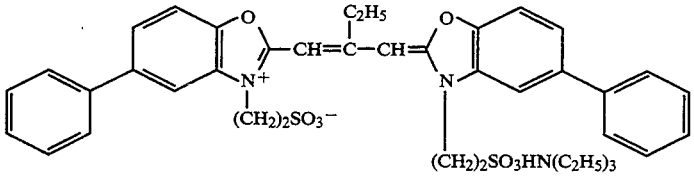 | $1.38 \times 10^{-3}$ |
| S-12 | 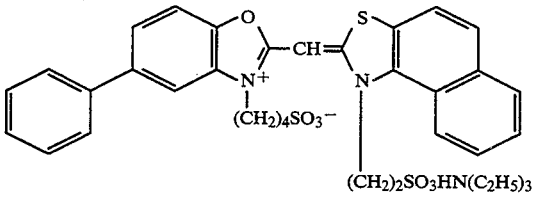 | $3.13 \times 10^{-3}$ |
| S-13 | 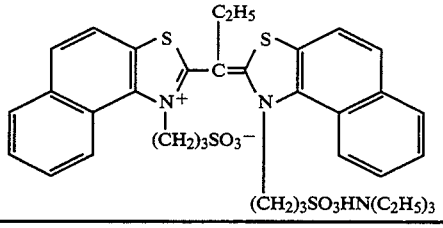 | $2.23 \times 10^{-3}$ |

In the invention, for mechanically pulverizing and dispersing a spectral sensitizing dye in an aqueous solvent, a variety of dispersing apparatuses may effectively be used. Typically, a high-speed stirrer, a ball-mill, a sand-mill, a colloid-mill, an attriter, a ultrasonic dispersing apparatus, and so forth may be used for. Among them, a high-speed stirrer is preferable in the invention.

A high-speed stirring type dispersing apparatus may also have a dissolver equipped with plural impellers on the vertical shaft thereof, or with a multi-shaft dissolver provided with plural vertical shafts. Besides an dissolver, a high-speed stirring type dispersing apparatus having anchor blades is more preferred.

In a typical example of the operations, after putting water into a tank capable of controlling temperatures, a given amount of powdered spectral sensitizing dye is put therein and is then stirred, pulverized and dispersed by a high-speed stirrer under thermal control for a given time. There is no special limitation to a pH and a temperature when mechanically dispersing the spectral sensitizing dye. However, at a low temperature, a desired particle-size cannot be obtained even when dispersed for a long time; and at a high temperature, there may raise such a problem that any desired photographic characteristics cannot be obtained, because a re-cohesion, a decomposition or the like may be occurred, or that the efficiencies of pulverization and dispersion of solid particles may seriously lowered, because the viscosity of a solution system may be lowered. Accordingly, a dispersion temperature is preferable to be within the range of 15 to 50° C. Further, a number of stirring revolution in dispersing operation is preferable to be within the range of 1000 to 6000 rpm, because, at a low number of revolution, it takes a long time to obtain a desired particle-size and, at a high number of revolution, babbles are taken in so as to lower a dispersion efficiency.

The solid fine particles of a spectral sensitizing dye, which are dispersed in the manner of the invention, has an average particle-size of not larger than 1 μm', herein means that a grain-size calculated out of the volumetric average size of spheres equivalent to the solid fine particles. It can be measured by an ordinary method.

The term, a dispersion, mentioned in the invention herein means a suspension of a spectral sensitizing dye. It is preferable to use a suspension solution containing a spectral sensitizing dye in an amount of 0.2% to 5.0% by weight.

A dispersion of spectral sensitizing dye of the invention may be added directly to a silver halide emulsion, or may be added upon diluting it suitably. In the latter case, water is used as a diluting solution.

In the case of constituting a light-sensitive material of the invention, a silver halide emulsion applicable thereto is generally physically ripened and spectrally sensitized. The additives applicable to the above-mentioned processes are given in Research Disclosure Nos. 17643, 18716 and 318119 (hereinafter abbreviated to as RD17643, RD18716 and RD308119).

The pages and paragraphs where the additives are given are shown in the following table.

| [Additive] | [Page of RD308119] | [RD17643] | [RD18716] |
|---|---|---|---|
| Chemical sensitizer | 996 III-A | 23 | 648 |
| Spectral sensitizer | 996 IV-A, B, C, D, H, I, J | 23–24 | 648–9 |
| Supersensitizer | 996 IV-A-E, J | 23–24 | 648–9 |
| Antifoggant | 998 VI | 24–25 | 649 |
| Stabilizer | 998 VI | 24–25 | 649 |

A chemical sensitization of an emulsion applicable to the invention can be carried out by a sulfur sensitization in which a compound containing a sulfur atom capable of reacting with silver ion or an active gelatin are used; a slenium sensitization in which a selenium compound is used; a reduction-sensitization in which a reducible substance is used; a-noble-metal sensitization in which gold or other noble metals are used; and so forth independently or in combination.

In the invention, for example, a chalcogen sensitizer can be used as a chemical sensitizer. Among them, a sulfur sensitizer and a selenium sensitizer are preferably used.

The sulfur sensitizers include, for example, a thiosulfate, allyl thiocarbamide, thiourea, allyl isothiocyanate, cystine, a p-toluene thiosulfonate and rhodanine.

Besides the above, it is also allowed to use such a sulfur sensitizer as given in U.S. Pat. Nos. 1,574,944, 2,410,689, 2,278,947, 2,728,668, 3,501,313 and 3,656,955; West German Patent Laying Open to Public Inspection of Application (OLS) No. 1,422,869; and JP OPI Publication Nos. 56-24937/1981 and 55-45016/1980.

An amount of a sulfur sensitizer to be added may be varied extending over a wide range under various conditions such as a pH, a temperature and a silver halide grain size. As a measure it is preferable to add it in an amount of the order of approximately $10^{-7}$ mols to $10^{-1}$ mols per mol of silver halide used.

A selenium sensitizer applicable thereto include, for example, an aliphatic isocyanate such as allyl isoselenocyanate; a selenourea; a selenide such as selenoselenide and diethyl selenide. The typical examples thereof are given in U.S. Pat. Nos. 1,574,944, 1,602,592 and 1,623,499. It is also allowed to make combination use of a reduction sensitization.

A reducing agent include, for example, stannous chloride, thiourea dioxide, hydrazine and polyamine. It is also allowed to make combination use of a noble-metal compound other than gold, that includes, for example, a palladium compound.

The silver halide grains of an emulsion applicable to the invention are preferable to contain a gold compound.

The gold compounds preferably applicable to the invention may each have a gold oxidation number of either 1 or 3'. Therefore, a variety of gold compounds may be used.

The typical examples of an aurate include potassium chloroaurate, auric trichloride, potassium auric thiocyanate, potassium iodoaurate, tetracyanoauric acid, ammonium aurothiocyanate, pyridyl trichlorogold, gold sulfide and gold selenide.

A gold compound may be so used as to sensitize silver halide grains, or may also be so used as not substantially contribute to any sensitization.

An amount of a gold compound to be added may be varied according to various conditions. The amount thereof to be added is within the range of $10^{-8}$ mols to $10^{-1}$ mols per mol of silver halide used and, preferably, $10^{-7}$ mols to $10^{-2}$ mols.

These compounds may be added at any points of time such as at the point of time when forming silver halide grains, when carrying out a physical ripening treatment, when carrying out a chemical ripening treatment and after completing a chemical ripening treatment.

The known additives for photographic use each applicable to the invention are given in the foregoing Research Disclosure.

Now, the pages and paragraphs where the additives are given will be shown below.

| [Item] | [Pages of RD308119] | [RD17643] | [RD18716] |
|---|---|---|---|
| Color-stain preventive | 1002 VII-I | 25 | 650 |
| Dye-image stabilizer | 1001 VII-J | 25 | |
| whitening agent | 998 V | 24 | |
| UV absorbent | 1003 VIII-C, XIIIC | 25–26 | |
| Light absorbent | 1003 VIII | 25–26 | |
| Light scattering agent | 1003 VIII | | |
| Filter dye | 1003 VIII | 25–26 | |
| Binder | 1003 IX | 26 | 651 |
| Antistatic agent | 1006 XIII | 27 | 650 |
| Layer hardener | 1004 X | 26 | 651 |
| Plasticizer | 1006 XII | 27 | 650 |
| Lubricant | 1006 XII | 27 | 650 |
| Activator.Coating aid | 1005 XI | 26–27 | 650 |
| Matting agent | 1007 XVI | | |
| Developing agent (contained in a light-sensitive material) | 1011 XXB | | |

For preventing photographic characteristics from any deterioration produced by formaldehyde gas, it is preferable to add the following compound to a light-sensitive material; a compound capable of fixing formaldehyde upon making reaction with the formaldehyde, of which is described in U.S. Pat. Nos. 4,411,987 and 4,435,503.

A variety of color couplers may be used in the invention. The typical examples thereof are given in the patents described in the foregoing Research Disclosure (RD) No. 17643, VII-C to G.

The preferable yellow couplers include, for example, those described in U.S. Pat. Nos. 3,933,051, 4,022,620, 4,326,024, 4,401,752 and 4,248,961; JP Examined Publication No. 58-10739/1983; British Patent Nos. 1,425,020 and 1,476,760; U.S. Pat. Nos. 3,973,968, 4,314,023 and 4,511,649; and European Pat. No. 279,473A.

The preferable magenta couplers include, for example, a compounds of the 5-pyrazolone type and the pyrazoloazole type, and the particularly preferable include, for example, those given in U.S. Pat. Nos. 4,310,619 and 4,351,897; European Patent. No. 73,636; U.S. Pat. Nos. 3,061,432 and 3,725,067; U.S. Pat. Nos. 3,061,432 and 3,725,067; Research Disclosure No. 24220 (June, 1984); JP OPI Publication No. 60-33552/1985; Research Disclosure No. 24230 (June, 1984); JP OPI Publication Nos. 60-43659/1985, 61-72238/1986, 60-35730/1985, 55-118034/1980 and 60-185951/1985; U.S. Pat. Nos. 4,500,630, 4,540,654 and 4,556,630; and International Pat. Publication No. WO88/04795.

The cyan couplers include, for example, those of the phenol type and those of the naphthol type and, preferably, those given in U.S. Pat. Nos. 4,502,212, 4,146,396, 4,228,233, 4,296,200, 2,369,929, 2,801,171, 1,772,162, 2,895,826, 3,772,002, 3,758,308, 4,334,011 and 4,327,173;

West German Patent (OLS) No. 3,329,729; European Pat. Nos. 121,365A and 249,453A; U.S. Pat. Nos. 3,446,622, 4,333,999, 4,775,616, 4,451,559, 4,427,767, 4,690,889, 4,254,212 and 4,296,199; and JP OPI Publication Nos. 61-42658/1986.

Colored couplers for compensating the unnecessary absorption of a color dye include, preferably, those given in Research Disclosure No. 17643, VII-G; U.S. Pat. No. 4,163,670; JP Examined Publication No. 57-39413/1982; U.S. Pat. Nos. 4,004,929 and 4,138,258; and British Patent No. 1,146,368. It is also preferable to make use of a coupler described in U.S. Pat. No. 4,774,181 capable of compensating the unnecessary absorption of a color dye by a fluorescent dye released in a coupling reaction; and a coupler having a dye-precursor group as an eliminating group capable of forming a dye upon making reaction with a developing agent, of which described in U.S. Pat. No. 4,777,120.

Couplers comprising a color dye having a suitable diffusibility include, preferably, those given in U.S. Pat. No. 4,366,237; British Patent No. 2,125,570; European Patent No. 96,570; and West German Patent (OLS) No. 3,234,533.

The typical examples of a polymerized dye-forming coupler are given in U.S. Pat. Nos. 3,451,820, 4,080,211, 4,367,282, 4,409,320 and 4,576,910; and British Patent No. 2,102,173.

A coupler capable of releasing a photographically useful residual group upon making a coupling reaction may also preferably be used in the invention. DIR couplers each capable of releasing a development inhibitor include, preferably, those given in the patent indicated in the foregoing RD 17643, VII-F; JP OPI Publication Nos. 57-151944/1982, 57-154234/1982, 60-184248/1985 and 63-37346/1988; and U.S. Pat. Nos. 4,248,962 and 4,782,012.

Couplers capable of releasing imagewise a nucleating agent or a development accelerator in the course of a development process include, preferably, those given in British Patent Nos. 2,097,140 and 2,131,188; and JP OPI Publication No. 59-157638/1984 and 59-170840/1984.

The other couplers applicable to the invention than the above include, for example, competing couplers given in U.S. Pat. No. 4,130,427; polyequivalent couplers given in U.S. Pat. Nos. 4,283,427, 4,338,393 and 4,310,618; DIR redox compound releasable couplers, DIR coupler releasable couplers, DIR coupler releasable redox compound or DIR redox releasable redox compound, each given in JP OPI Publication Nos. 60-185950/1985 and 62-24252/1987; couplers capable of releasing a dye recolored after being eliminated, each given in European Patent No. 173,302A; bleach-accelerator releasable couplers given in RD Nos. 11449 and 24241 and JP OPI Publication No. 61-201247/1986; ligand releasable couplers given in U.S. Pat. No. 4,553,477; couplers capable of releasing a leuco dye given in JP OPI Publication No. 63-75747/1988; and couplers capable of releasing a fluorescent dye, given in U.S. Pat. No. 4,774,181.

Besides the above, a variety of couplers may be used in the invention. The typical examples thereof are given in the following RDs. The pages and paragraphs thereof will be given below.

| [Item] | [Pages of RD308119] | [RD17643] |
|---|---|---|
| Yellow coupler | 1001 VII-D | VII C–G |
| Magenta coupler | 1001 VII-D | VII C–G |

-continued

| [Item] | [Pages of RD308119] | [RD17643] |
|---|---|---|
| Cyan coupler | 1001 VII-D | VII C–G |
| Colored coupler | 1002 VII-G | VII G |
| DIR coupler | 1001 VII-F | VII F |
| BAR coupler | 1002 VII-F | |
| other useful group-releasing coupler | 1001 VII-F | |

The additives applicable to the invention can be added in such a dispersion method as described in RD308119, XIV.

In the invention, it is allowed to use such a support as described in the foregoing RD17643, p. 28, RD18716, pp. 647–8, and RD308119, XIX.

To a light-sensitive material of the invention, it is allowed to provide such an auxiliary layers as a filter layer and an interlayer each described in the foregoing RD308119, VII-K.

With a light-sensitive material of the invention, the pH of the uppermost surface of the photographic component layer thereof is to be within the range of 5.0 to 7.0 and, preferably, 5.5 to 6.5. Such a pH as mentioned above may be measured in the method described in JP OPI Publication No. 61-245153/1986.

Supports suitably applicable to the invention are given in, for example, the foregoing RD No. 17643, p. 28 and, ibid., No. 18716, from the right column on p. 647 to the left column on p. 648.

The typical supports applicable to the invention include paper laminated with polyethylene or the like, polyethylene terephthalate film, baryta paper and cellulose triacetate film. The thickness of a support applicable thereto is ordinarily within the range of 50 to 200 μm.

When making use of a light-sensitive material of the invention in the rolled form, it is preferable to take the form of putting it in a cartridge. The most popular type of the cartridges is that of the 135 format being currently used. Besides, cartridges proposed by the following patents may also be used. (Japanese Utility Model No. 58-67329/1983; JP OPI Publication Nos. 58-181035/1983 and 58-182634/1983; Japanese Utility Model No. 58-195236/1983; U.S. Pat. No. 4,221,479; JP Application Nos. 63-57785/1988, 63-183344/1988 and 63-325638/1988; JP Application Nos. 1-21862/1989, 1-25362/1989, 1-30246/1989, 1-20222/1989, 1-21863/1989, 1-37181/1989, 1-33108/1989, 1-85198/1989, 1-172595/1989, 1-172594/1989 and 1-172593/1989; and U.S. Pat. Nos. 4,846,418, 4,848,693 and 4,832,275)

The invention can be applied to "a roll film patrone for photographic use and a film camera each of the miniature type" disclosed in JP Application No. 4-16934/1992.

For obtaining a dye-image with the use of a light-sensitive material of the invention, a commonly known development process can be carried out after exposing the light-sensitive material to light.

A light-sensitive material of the invention can be developed in any commonly known process such as those described in the foregoing RD17643, pp. 28–29, RD18716, p. 647, and RD308119, XII.

EXAMPLES

Now, the typical examples of the invention will be detailed below. However, the embodiments of the invention shall not be limited thereto.

In the following every example, an amount of each component added to a silver halide photographic light-sensitive material is indicated by a coated amount expressed in terms of g/m$^2$, provided, however, that a silver halide coating amount is indicated by an equivalent amount of silver, and a sensitizing dye coating amount is indicated by mol per mol of silver halide contained in the same layer.

Example 1

Sample 101 was prepared to be a multilayered color light-sensitive material comprising a subbed cellulose triacetate film support bearing thereon each of layers having the following compositions.

| Sample 101 | |
|---|---|
| Layer 1: An antihalation layer | |
| Black colloidal silver | 0.15 |
| UV absorbent (UV-1) | 0.30 |
| High boiling solvent (Oil-1) | 0.16 |
| Gelatin | 1.64 |
| Layer 2: an interlayer | |
| Gelatin | 0.80 |
| Layer 3: A low-speed red-sensitive layer | |
| Silver iodobromide emulsion A | 0.44 |
| Silver iodobromide emulsion C | 0.11 |
| Sensitizing dye (SD-1) | $2.6 \times 10^{-5}$ |
| Sensitizing dye (SD-2) | $2.6 \times 10^{-5}$ |
| Sensitizing dye (SD-3) | $3.1 \times 10^{-4}$ |
| Sensitizing dye (SD-4) | $2.3 \times 10^{-5}$ |
| Sensitizing dye (SD-5) | $2.8 \times 10^{-4}$ |
| Cyan coupler (C-1) | 0.35 |
| Colored cyan coupler (CC-1) | 0.065 |
| Compound (GA-1) | $2.0 \times 10^{-3}$ |
| High boiling solvent (Oil-1) | 0.33 |
| Gelatin | 0.73 |
| Layer 4: A medium-speed red-sensitive layer | |
| Silver iodobromide emulsion C | 0.39 |
| Sensitizing dye (SD-l) | $1.3 \times 10^{-4}$ |
| Sensitizing dye (SD-2) | $1.3 \times 10^{-4}$ |
| Sensitizing dye (SD-3) | $2.5 \times 10^{-4}$ |
| Sensitizing dye (SD-4) | $1.8 \times 10^{-5}$ |
| Cyan coupler (C-1) | 0.24 |
| Colored cyan coupler (CC-1) | 0.040 |
| DIR compound (D-1) | 0.025 |
| Compound (GA-1) | $1.0 \times 10^{-3}$ |
| High boiling solvent (Oil-1) | 0.30 |
| Gelatin | 0.59 |
| Layer 5: A high-speed red-sensitive layer | |
| Silver iodobromide emulsion D | 0.91 |
| Sensitizing dye (SD-1) | $8.5 \times 10^{-5}$ |
| Sensitizing dye (SD-2) | $9.1 \times 10^{-5}$ |
| Sensitizing dye (SD-3) | $1.7 \times 10^{-4}$ |
| Sensitizing dye (SD-4) | $2.3 \times 10^{-5}$ |
| Sensitizing dye (SD-6) | $1.1 \times 10^{-5}$ |
| Cyan coupler (C-2) | 0.10 |
| Colored cyan coupler (CC-1) | 0.014 |
| DIR compound (D-1) | $7.5 \times 10^{-3}$ |
| Compound (GA-1) | $1.4 \times 10^{-3}$ |
| High boiling solvent (Oil-1) | 0.12 |
| Gelatin | 0.53 |
| Layer 6: An interlayer | |
| Gelatin | 1.14 |
| Layer 7: A low-speed green-sensitive layer | |
| Silver iodobromide emulsion B | 0.32 |
| Silver iodobromide emulsion C | 0.74 |
| Sensitizing dye (SD-7) | $5.5 \times 10^{-4}$ |
| Sensitizing dye (SD-1) | $5.2 \times 10^{-5}$ |
| Sensitizing dye (SD-1) | $4.8 \times 10^{-5}$ |
| Magenta coupler (M-1) | 0.15 |
| Magenta coupler (M-2) | 0.37 |

-continued

| Sample 101 | |
|---|---|
| Colored magenta coupler (CM-1) | 0.20 |
| DIR compound (D-2) | 0.020 |
| Compound (GA-1) | $4.0 \times 10^{-3}$ |
| High boiling solvent (Oil-2) | 0.65 |
| Gelatin | 1.65 |
| Layer 8: A high-speed green-sensitive layer | |
| Silver iodobromide emulsion E | 0.79 |
| Sensitizing dye (SD-8) | $1.4 \times 10^{-4}$ |
| Sensitizing dye (SD-9) | $1.5 \times 10^{-4}$ |
| Sensitizing dye (SD-10) | $1.4 \times 10^{-4}$ |
| Sensitizing dye (SD-12) | $7.1 \times 10^{-5}$ |
| Magenta coupler (M-2) | 0.065 |
| Magenta coupler (M-3) | 0.025 |
| Colored magenta coupler (CM-2) | 0.025 |
| DIR compound (D-3) | $7.0 \times 10^{-4}$ |
| Compound (GA-1) | $1.8 \times 10^{-3}$ |
| High boiling solvent (Oil-2) | 0.15 |
| Gelatin | 0.46 |
| Layer 9: A yellow filter layer | |
| Yellow colloidal silver | 0.10 |
| Compound (SC-1) | 0.14 |
| Compound (FS-1) | 0.20 |
| High boiling solvent (oil-2) | 0.18 |
| Gelatin | 1.20 |
| Layer 10: A low-speed blue-sensitive layer | |
| Silver iodobromide emulsion B | 0.27 |
| Silver iodobromide emulsion C | 0.32 |
| Sensitizing dye (SD-11) | $5.4 \times 10^{-4}$ |
| Sensitizing dye (SD-12) | $2.0 \times 10^{-4}$ |
| Sensitizing dye (SD-6) | $6.5 \times 10^{-5}$ |
| Yellow coupler (Y-1) | 0.62 |
| Yellow coupler (Y-2) | 0.31 |
| Compound (GA-1) | $4.5 \times 10^{-3}$ |
| High boiling solvent (Oil-2) | 0.20 |
| Gelatin | 1.27 |
| Layer 11: A high-speed blue-sensitive layer | |
| Silver iodobromide emulsion E | 0.66 |
| Sensitizing dye (SD-11) | $2.8 \times 10^{-4}$ |
| Sensitizing dye (SD-12) | $1.1 \times 10^{-4}$ |
| Sensitizing dye (SD-6) | $1.1 \times 10^{-5}$ |
| Yellow coupler (Y-1) | 0.10 |
| Compound (GA-1) | $2.0 \times 10^{-3}$ |
| High boiling solvent (Oil-2) | 0.04 |
| Gelatin | 0.57 |
| Layer 12: Protective layer 1 | |
| Silver iododbromide emulsion (having an average grain-size of 0.04 μm and a silver iodide content of 4.0 mol %) | 0.30 |
| UV absorbent (UV-2) | 0.030 |
| UV absorbent (UV-3) | 0.015 |
| UV absorbent (UV-4) | 0.015 |
| UV absorbent (UV-5) | 0.015 |
| UV absorbent (UV-6) | 0.10 |
| Compound (FS-1) | 0.25 |
| High boiling solvent (Oil-1) | 0.07 |
| High boiling solvent (Oil-3) | 0.07 |
| Gelatin | 1.04 |
| Layer 13: Protective layer 2 | |
| Alkali-soluble matting agent (having an average particle size of 2 μm) | 0.15 |
| Polymethyl methacrylate (having an average particle size of 3 μm) | 0.04 |
| Lubricant (WAX-1) | 0.04 |
| Gelatin | 0.55 |

Besides the above-given compositions, there added coating-aid Su-1, dispersing agent Su-2, a viscosity controller, hardeners H-1 and H-2, stabilizer ST-1, antifoggant AF-1, dyes AI-1 and AI-2, two kinds of AF-2 having the molecular weights of 10,000 for one and 20,000 for the other, and antiseptics DI-1, respectively.

The emulsions applied to the emulsions were as follows. The average grain-sizes thereof were indicated by the grain-sizes converted into the diameters of the spheres having the same volumes of the emulsion grain-sizes, respectively. Each of the emulsions was subjected to the optimum gold-sulfur sensitization.

| Emulsion name | Average AgI content (in mol %) | Average grain-size (in μm) | Variation coeffcient | Crystal form | Ratio of diameter to thickness |
|---|---|---|---|---|---|
| Emulsion A | 2.0 | 0.27 | 0.14 | Normal tetradecahedron | 1 |
| Emulsion B | 2.0 | 0.30 | 0.17 | Normal tetradecahedron | 1 |
| Emulsion C | 8.0 | 0.38 | 0.18 | Twinned octahedron | 1.5 |
| Emulsion D | 8.0 | 0.55 | 0.15 | Twinned octahedron | 1.5 |
| Emulsion E | 8.0 | 0.65 | 0.18 | Twinned octahedron | 1.5 |

C-1

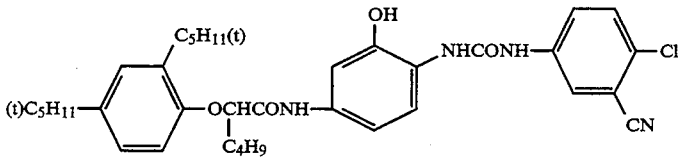

C-2

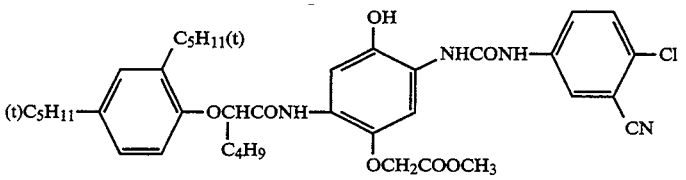

M-1

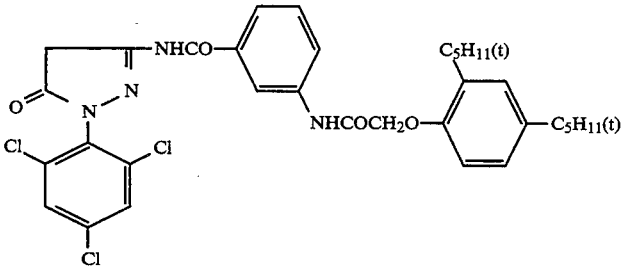

M-2

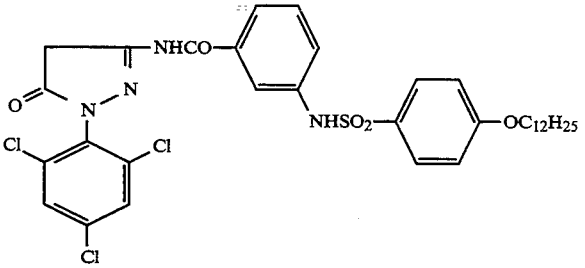

M-3

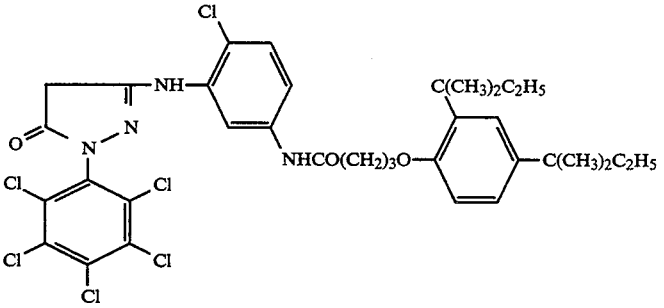

-continued
Y-1
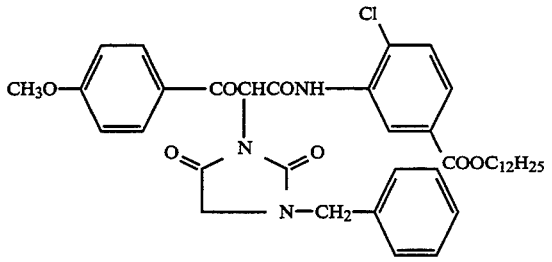
Y-2
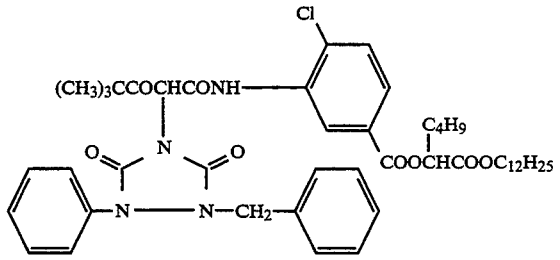
CC-1
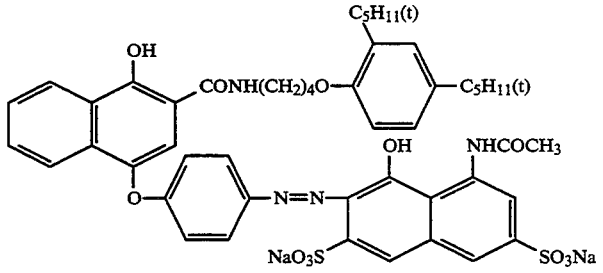
CM-1
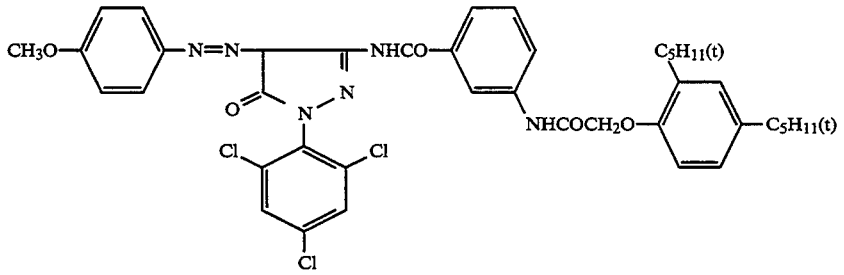
CM-2
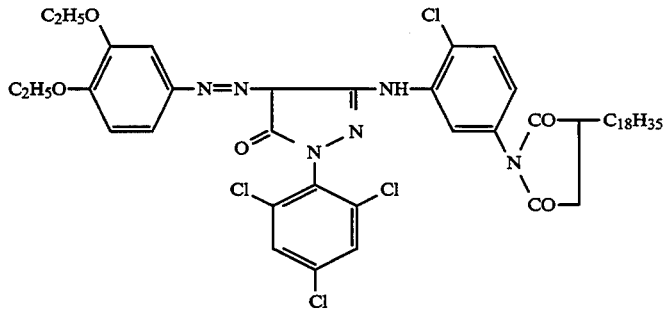
D-1

-continued
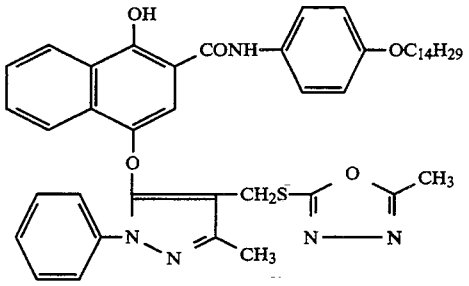
D-2
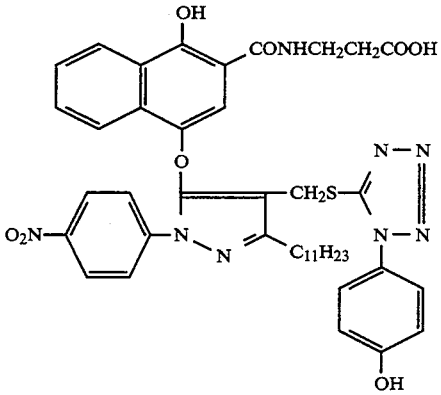
D-3
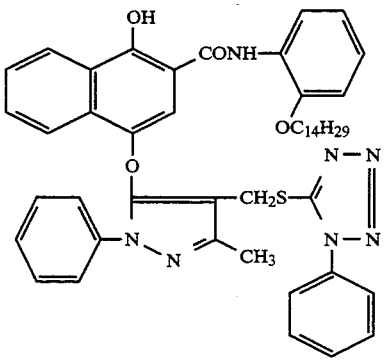
Oil-1
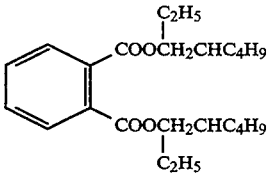
Oil-2
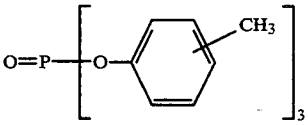
Oil-3
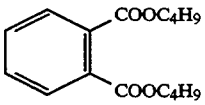
GA-1

-continued
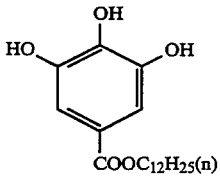
SC-1
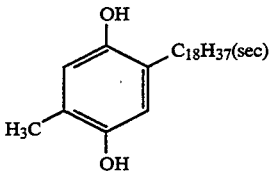
FS-1
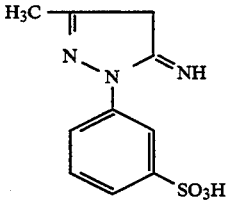
UV absorbent
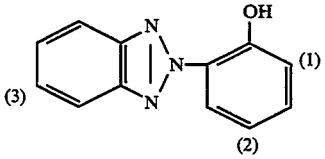
| | (1) | (2) | (3) |
|---|---|---|---|
| UV-1 | $-C_{12}H_{25}$ | $-CH_3$ | $-H$ |
| UV-2 | $-H$ | $-(t)C_4H_9$ | $-H$ |
| UV-3 | $-(t)C_4H_9$ | $-(t)C_4H_9$ | $-H$ |
| UV-4 | $-(t)C_4H_9$ | $-CH_3$ | $-Cl$ |
| UV-5 | $-(t)C_4H_9$ | $-(t)C_4H_9$ | $-Cl$ |
UV-6
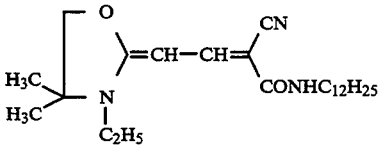
SD-1
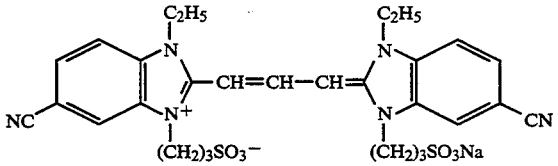
SD-2
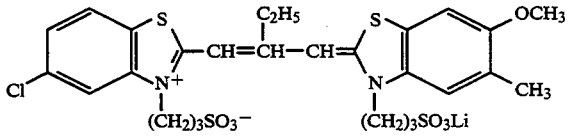
SD-3
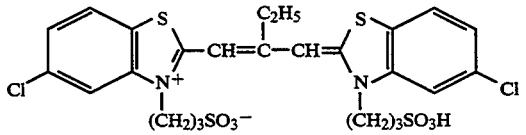

-continued
SD-4
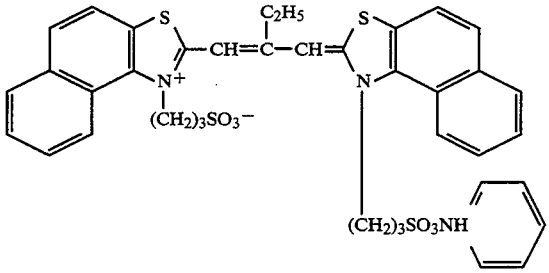
SD-5
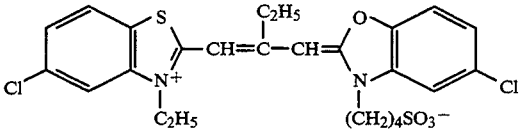
SD-6
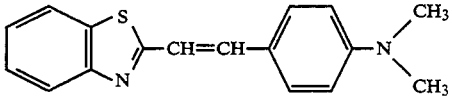
SD-7
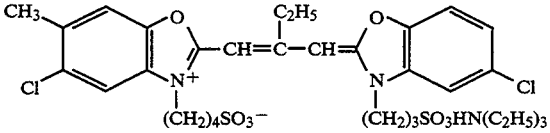
SD-8
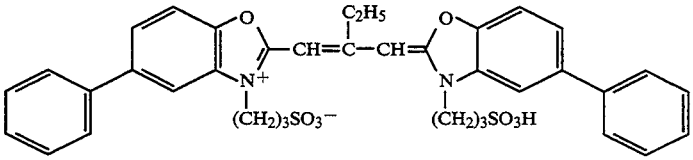
SD-9
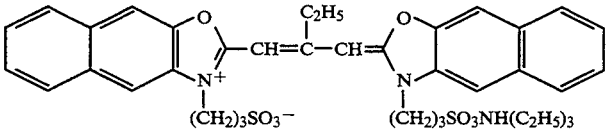
SD-10
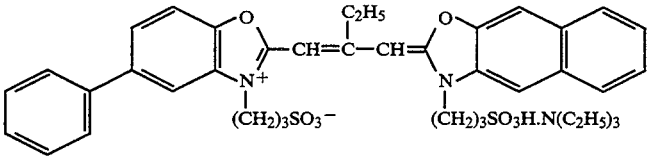
SD-11
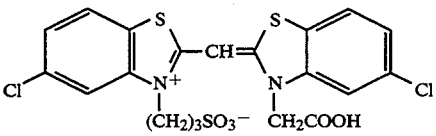
SD-12

-continued
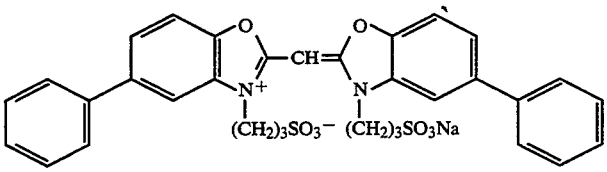
H-1
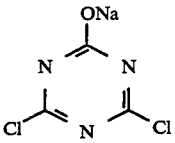
H-2
$(CH_2{=}CHSO_2CH_2)_2O$
AI-1
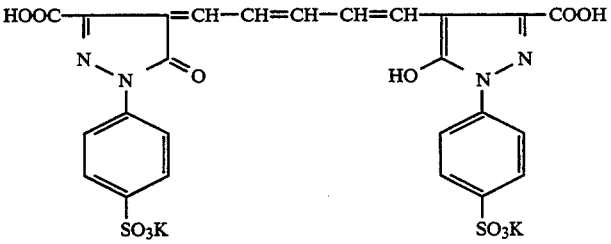
AI-2
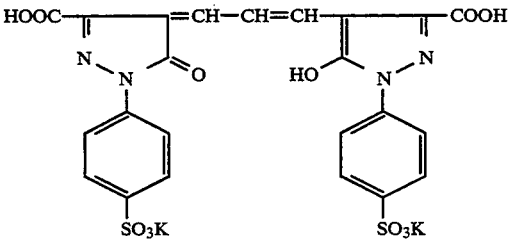
WAX-1
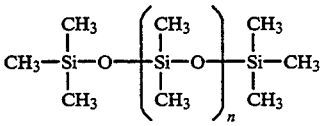
Weight average molecular weight Mw = 3,000
SU-1
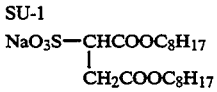
SU-2
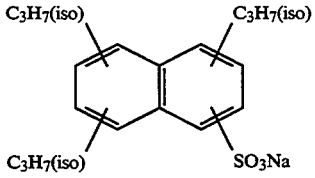
ST-1
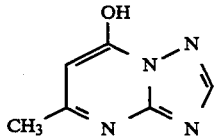
AF-1

-continued

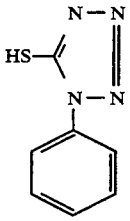

AF-2

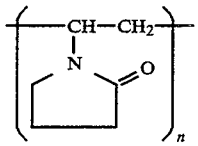

n: Polymerization degree

DI-1

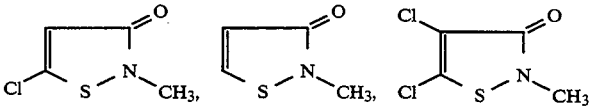

(Component A) (Component B) (Component C)

Component A:Component B:Component C = 50:46:4 (in mol ratio)

Samples 101 through 110 were each prepared by changing the manner of adding a spectral sensitizing dye(s) that was to be added when carrying out a spectral sensitization, or by changing the silver amounts which were to be coated on each of the red, green and blue light-sensitive layers, as shown in Table 3. The pH values of the uppermost surfaces of the photographic component layers of every sample were each adjusted to be 5.9. In the table, the manner in which the sensitizing dye was added is as follows.

a: A solution prepared by dissolving 10 g of the dye in 2 kg of methanol at 27° C. was added to a silver halide emulsion.

b: A dispersion prepared by dispersing the dye (10 g) in water (490 g) in the form of solid particles having an average size of 0.2 μm was added to a silver halide emulsion.

TABLE 3

| Sample No. | Sensitizing dye adding manner | Emulsion & Ag amt. of Layer 3 | Emulsion & Ag amt. of Layer 4 | Emulsion & Ag amt. of Layer 5 | Emulsion & Ag amt. of Layer 7 | Emulsion & Ag amt. of Layer 8 | Emulsion & Ag amt. of Layer 10 | Emulsion & Ag amt. of Layer 11 | Total coating amount of silver (g/m²) | ISO speed |
|---|---|---|---|---|---|---|---|---|---|---|
| 101 (Comparison) | a | A 0.44 C 0.11 | C 0.39 | D 0.91 | B 0.32 C 0.74 | E 0.79 | B 0.27 C 0.32 | F 0.66 | 5.50 | 110 |
| 102 (Comparison) | a | A 0.37 C 0.092 | C 0.33 | D 0.76 | B 0.27 C 0.62 | E 0.67 | B 0.23 C 0.27 | F 0.56 | 4.70 | 108 |
| 103 (Comparison) | a | A 0.33 C 0.082 | C 0.29 | D 0.68 | B 0.24 C 0.54 | E 0.57 | B 0.20 C 0.24 | F 0.48 | 4.20 | 107 |
| 104 (Comparison) | b | A 0.33 C 0.082 | C 0.29 | D 0.68 | B 0.24 C 0.54 | E 0.57 | B 0.20 C 0.24 | F 0.48 | 4.20 | 109 |
| 105 (Comparison) | a | A 0.29 C 0.073 | C 0.26 | D 0.56 | B 0.21 C 0.49 | E 0.45 | B 0.18 C 0.21 | F 0.38 | 3.65 | 100 |
| 106 (Invention) | b | A 0.29 C 0.073 | C 0.26 | D 0.56 | B 0.21 C 0.49 | E 0.45 | B 0.18 C 0.21 | F 0.38 | 3.65 | 105 |
| 107 (Comparison) | a | A 0.22 C 0.055 | C 0.20 | D 0.47 | B 0.16 C 0.36 | E 0.38 | B 0.13 C 0.16 | F 0.32 | 3.00 | 90 |
| 108 (Invention) | b | A 0.22 C 0.055 | C 0.20 | D 0.47 | B 0.16 C 0.36 | E 0.38 | B 0.13 C 0.16 | F 0.32 | 3.00 | 94 |
| 109 (Comparison) | a | A 0.17 C 0.042 | C 0.15 | D 0.36 | B 0.12 C 0.27 | E 0.28 | B 0.097 C 0.12 | F 0.24 | 2.40 | 78 |
| 110 (Invention) | b | A 0.17 C 0.042 | C 0.15 | D 0.36 | B 0.12 C 0.27 | E 0.28 | B 0.097 C 0.12 | F 0.24 | 2.40 | 81 |

*Value includes non-light-sensitive silver halide grains and colloidal silver grains each contained in a non-color-sensitive layer.

The resulting Samples No. 101 through No. 110 were each exposed to white light through a wedge and then developed in the following processing A and B. Thereafter, the RMS values and ISO speeds thereof were each measured.

The RMS values were indicated by the following manner. A density of the minimum density plus 1.0 of each sample was scanned by making use of a microdensitometer having an aperture scanning area of 1800 μm² (with a slit width of 10 μm and a slit length of 180 μm) under green light through a Wratten filter manufactured by Eastman Kodak Co., and the standard deviation of the resulting density variations of not less than 1000 sampled pieces subjected to the density measurements were so multiplied by 1000 as to indicate the RMS values, respectively.

The RMS values were each indicated by a value relative to that of Sample No. 101 that was regarded as a value of 100. The smaller the value was, the better the graininess was. The results thereof will be shown in Table 2.

| Processing A | | |
|---|---|---|
| Step | Time | Temperature |
| 1. Color developing | 3 min. 15 sec. | 38.0 ± 0.1° C. |
| 2. Bleaching | 6 min. 30 sec. | 38.0 ± 3.0° C. |
| 3. Washing | 3 min. 15 sec. | 24° C. to 41° C. |
| 4. Fixing | 6 min. 30 sec. | 38.0 ± 3.0° C. |
| 5. washing | 3 min. 15 sec. | 24° C. to 41° C. |
| 6. Stabilizing | 3 min. 15 sec. | 38.0 ± 3.0° C. |
| 7. Drying | | ≦50° C. |

In each of the processing steps, the compositions of the processing solutions used therein were as follows.

| | |
|---|---|
| <Color developing solution> | |
| 4-amino-3-methyl-N-ethyl-N-(β-hydroxyethyl)-aniline sulfate | 4.75 g |
| Sodium sulfite anhydride | 4.25 g |
| Hydroxylamine.½ sulfate | 2.00 g |
| Potassium carbonate anhydride | 37.5 g |
| Sodium bromide | 1.30 g |
| Trisodium nitrilotriacetate (monohydrate) | 2.50 g |
| Potassium hydroxide | 1.00 g |
| Add water to make | 1 liter |
| Adjust pH to be | 10.1 |
| <Bleaching solution> | |
| iron ammonium ethylenediamine tetraacetate | 100.0 g |
| Diammonium ethylenediamine tetraacetate | 10.0 g |
| Ammonium bromide | 150.0 g |
| Glacial acetic acid | 10.0 g |
| Add water to make | 1 liter |
| Adjust pH with aqueous ammonia to be | 6.0 |
| <Fixing solution> | |
| Ammonium thiosulfate | 175.0 g |
| Sodium sulfite anhydride | 8.5 g |
| Sodium metasulfite | 2.3 g |
| Add water to make | 1 liter |
| Adjust pH with acetic acid to be | 6.0 |
| <Stabilizing solution> | |
| Formalin (in an aqueous 37% solution) | 1.5 cc |
| Konidux (manufactured by Konica Corp.) | 7.5 cc |
| Add water to make | 1 liter |

| Processing B | | | |
|---|---|---|---|
| Step | Time | Temperature | Replenishing* amount |
| Color developing | 3 min. 15 sec. | 38 ± 0.3° C. | 700 ml |
| Bleaching | 45 sec. | 38 ± 2.0° C. | 150 ml |
| Fixing | 1 min. 30 sec. | 38 ± 2.0° C. | 830 ml |
| Stabilizing | 60 sec. | 38 ± 5.0° C. | 830 ml |
| Drying | 1 min. | 58 ± 5.0° C. | — |

*Replenishing amounts were each a value per $m^2$ of a subject light-sensitive material.

The color developing solution, bleaching solution, fixing solution, stabilizing solution and the replenishing solutions thereof were as follows. Color developing solution]

| [Color developing solution] | |
|---|---|
| Water | 800 ml |
| Potassium carbonate | 30 g |
| Sodium hydrogen carbonate | 2.5 g |
| Potassium sulfite | 3.0 g |
| Sodium bromide | 1.3 g |
| Potassium iodide | 1.2 mg |

-continued

| | |
|---|---|
| Hydroxylamine sulfate | 2.5 g |
| Sodium chloride | 0.6 g |
| 4-amino-3-methyl-N-ethyl-N-(β-hydroxylethyl)aniline sulfate | 4.5 g |
| Diethylene triamine pentaacetic acid | 3.0 g |
| Potassium hydroxide | 1.2 g |
| Add water to make | 1 liter |
| Adjust pH with potassium hydroxide or a 20% sulfuric acid to be | 10.06 |
| [Replenishing solution for color developing solution] | |
| Water | 800 ml |
| Potassium carbonate | 35 g |
| Sodium hydrogen carbonate | 3 g |
| Potassium sulfite | 5 g |
| Sodium bromide | 0.4 g |
| Hydroxyl amine sulfate | 3.1 g |
| 4-amino-3-methyl-N-ethyl-N-(β-hydroxylethyl)aniline sulfate | 6.3 g |
| Potassium hydroxide | 2 g |
| Diethylene triamine pentaacetic acid | 3.0 g |
| Add water to make | 1 liter |
| Adjust pH with potassium hydroxide or 20% sulfuric acid to be | 10.18 |
| [Bleaching solution] | |
| Water | 700 ml |
| Iron (III) ammonium 1,3-diaminopropane tetraacetate | 125 g |
| Ethylenediamine tetraacetic acid | 2 g |
| Sodium nitrate | 40 g |
| Ammonium bromide | 150 g |
| Glacial acetic acid | 40 g |
| Add water to make | 1 liter |
| Adjust pH with aqueous ammonia or glacial acetic acid to be | 4.4 |
| [Replenishing solution for bleaching solution] | |
| Water | 700 ml |
| Iron (III) ammonium 1,3-diaminopropane tetraacetate | 175 g |
| Ethylenediamine tetraacetic acid | 2 g |
| Sodium nitrate | 50 g |
| Ammonium bromide | 200 g |
| Glacial acetic acid | 56 g |
| Adjust pH with aqueous ammonia or glacial acetic acid to be | 4.0 |
| And then add water to make | 1 liter |
| [Fixing solution] | |
| Water | 800 ml |
| Ammonium thiocyanate | 120 g |
| Ammonium thiosulfate | 150 g |
| Sodium sulfite | 15 g |
| Ethylenediamine tetraacetic acid | 2 g |
| Adjust pH with aqueous ammonia or glacial acetic acid to be | 6.2 |
| And then add water to make | 1 liter |
| [Replenishing solution for fixing solution] | |
| Water | 800 ml |
| Ammonium thiocyanate | 150 g |
| Ammonium thiosulfate | 180 g |
| Sodium sulfite | 20 g |
| Ethylenediamine tetraacetic acid | 2 g |
| Adjust PH with aqueous ammonia or glacial acetic acid to be | 6.5 |
| And then add water to make | 1 liter |
| [Stabilizing solution and the replenishing solution thereof] | |
| Water | 900 ml |
| 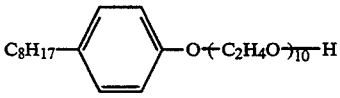 | 2.0 g |
| Dimethylol urea | 0.5 g |
| Hexamethylene tetramine | 0.2 g |
| 1,2-benzisothiazoline-3-one | 0.1 g |
| Siloxane (L-77 manufactured by UCC) | 0.1 g |
| Aqueous ammonia | 0.5 ml |
| Add water to make | 1 liter |
| Adjust pH with aqueous ammonia or | 8.5 |

-continued

| |
|---|
| 50% sulfuric acid to be |

TABLE 4

| Sample No. | RMS value (Processing A) | RMS value (Processing B) |
|---|---|---|
| 101 (Comparison) | 100 | 100 |
| 102 (Comparison) | 107 | 108 |
| 103 (Comparison) | 115 | 114 |
| 104 (Comparison) | 110 | 110 |
| 105 (Comparison) | 120 | 122 |
| 106 (Invention) | 102 | 100 |
| 107 (Comparison) | 133 | 128 |
| 108 (Invention) | 103 | 103 |
| 109 (Comparison) | 144 | 147 |
| 110 (Invention) | 108 | 107 |

From the results of Table 4, it is shown that there was almost no deterioration of the graininess of the green-sensitive layers of the samples of the invention in which the silver amounts of the light-sensitive materials were remarkably reduced, and also that the same results were obtained from the blue-sensitive and red-sensitive layers.

Example 2

For evaluating the processability, samples No. 101 through No. 110 prepared in Example 1 were each exposed wedgewise to white light and, in both cases when the foregoing processing B was carried out and when processing C in which the time for carrying out the bleaching step was shortened by one half was carried out, the residual silver amounts (silver retention) produced by a desilvering failure was measured.

When a value of the residual silver amount is not higher than 5 $\mu g/cm^2$, the level thereof may raise almost no problem. The results thereof will be shown in Table 5.

TABLE 5

| Sample No. | Residual silver amount, $\mu g/cm^2$ |
|---|---|
| 101 (Comparison) | 10 |
| 102 (Comparison) | 8 |
| 103 (Comparison) | 7 |
| 104 (Comparison) | 7 |
| 105 (Comparison) | 6 |
| 106 (Invention) | 4 |
| 107 (Comparison) | 5 |
| 108 (Invention) | 3 |
| 109 (Comparison) | 4 |
| 110 (Invention) | 2 |

From the results of Table 5, it was shown that the samples of the invention were excellent in processability, particularly in bleachability.

Example 3

For evaluating the preservability, a forced aging tests was carried out. After aging samples No. 101 through No. 110 under the following conditions (a) and (b), each of the samples was exposed wedgewise to white light and was then developed by the foregoing processing A. The density variation of the fog density of the green-sensitive layer of each sample (ΔFog) was measured between the samples preserved under conditions (b) and (a), and the results thereof were shown in Table 4.

Condition (a): A sample was preserved at 23° C. and 55%RH for one day, and was then refrigerated; and Condition (b): A sample was preserved under the high-temperature and high-humidity conditions at 40° C. and 80%RH for 7 days.

TABLE 6

| Sample No. | ΔFog of green-sensitivity |
|---|---|
| 101 (Comparison) | 0.16 |
| 102 (Comparison) | 0.14 |
| 103 (Comparison) | 0.14 |
| 104 (Comparison) | 0.11 |
| 105 (Comparison) | 0.11 |
| 106 (Invention) | 0.06 |
| 107 (Comparison) | 0.08 |
| 108 (Invention) | 0.05 |
| 109 (Comparison) | 0.07 |
| 110 (Invention) | 0.04 |

From the results of Table 6, it was shown that the samples of the invention were excellent in storage stability. The same results were obtained from the blue-sensitive layer and the red-sensitive layer.

Example 4

Processing D were carried out in the same manner as in Example 1, except that 4-amino-3-methyl-N-ethyl-N-(β-hydroxyethyl)aniline sulfate used in Processing B was replaced by 4-amino-3-methyl-N-ethyl-N-(β-methylsulfonyl ethyl)aniline sulfate in the same mols. In the same manner as in Example 1, the RMS values were evaluated. In the same manner as in Example 2, the residual silver amounts were measured. And, in the same manner as in Example 3, the storage stabilities were evaluated. Resultingly, the effects of the invention were obtained.

What is claimed is:

1. A silver halide color photographic light sensitive material comprising a support having thereon a blue-sensitive silver halide emulsion layer, a green-sensitive silver halide emulsion layer, a red-sensitive silver halide emulsion layer, and a nonlight-sensitive hydrophilic colloidal layer, wherein said color photographic material has a coating weight of silver of not more than 4.0 g per $m^2$ of a photographic material and an ISO speed of 25 or more, and wherein a silver halide emulsion contained in at least one of said light-sensitive emulsion layers is spectrally sensitized by a process comprising forming a dispersion of a substantially water-insoluble spectral sensitizing dye in the form of solid particles dispersed in an aqueous medium and incorporating the dispersion in the silver halide emulsion.

2. The silver halide color photographic material of claim 1, wherein a solubility of said sensitizing dye in water is within the range of $2\times10^{-4}$ to $4\times10^{-2}$ mol per liter of water at 27° C.

3. The silver halide color photographic material of claim 1, wherein said solid particles of said sensitizing dye have an average size of 1 μm or less in diameter.

4. The silver halide color photographic material of claim 1, wherein said aqueous medium is essentially free of organic solvent or surfactant.

5. The silver halide color photographic material of claim 1, wherein said spectral sensitizing dye is contained in the dispersion in an amount of 0.2 to 5.0% by weight.

6. The silver halide color photographic material of claim 1, wherein said spectrally sensitized silver halide emulsion comprises monodispersed silver halide grains having a variation coefficient of not more than 0.2.

7. The silver halide color photographic material of claim 1 wherein said coating weight of silver is 1.5 to 4.0 $g/m^2$.

8. The silver halide color photographic material of claim 7 wherein the coating weight of silver is 2.5 to 4.0 $g/m^2$.

* * * * *